US009049755B2

(12) United States Patent
Ku et al.

(10) Patent No.: US 9,049,755 B2
(45) Date of Patent: Jun. 2, 2015

(54) PROGRAMMABLE FLOODLIGHT WITH PUSHBUTTON CONTROL

(71) Applicant: Coleman Cable, Inc., Waukegan, IL (US)

(72) Inventors: Shiao-Tsun Ku, Waukegan, IL (US); Chu-Ching Wang, Taipei (TW)

(73) Assignee: Coleman Cable, LLC, Waukegan, IL (US)

( * ) Notice: Subject to any disclaimer, the term of this patent is extended or adjusted under 35 U.S.C. 154(b) by 0 days.

(21) Appl. No.: 13/835,883

(22) Filed: Mar. 15, 2013

(65) Prior Publication Data

US 2014/0265871 A1 Sep. 18, 2014

(51) Int. Cl.

| | |
|---|---|
| ***H01J 1/60*** | (2006.01) |
| ***H01J 7/42*** | (2006.01) |
| ***H05B 37/04*** | (2006.01) |
| ***H05B 37/02*** | (2006.01) |

(52) U.S. Cl.
CPC ..... *H05B 37/0245* (2013.01)

(58) Field of Classification Search
USPC ..... 315/152
See application file for complete search history.

(56) References Cited

U.S. PATENT DOCUMENTS

| | | | | |
|---|---|---|---|---|
| D427,101 | S | 6/2000 | Leen | |
| 6,151,529 | A * | 11/2000 | Batko | 700/28 |
| D435,799 | S | 1/2001 | Leen | |
| D438,133 | S | 2/2001 | Leen | |
| D453,387 | S | 2/2002 | Leen | |
| 6,472,997 | B2 | 10/2002 | Leen | |
| 6,781,129 | B2 | 8/2004 | Leen | |
| 6,994,445 | B1 * | 2/2006 | Pomes | 362/106 |
| 7,339,471 | B1 * | 3/2008 | Chan et al. | 340/541 |
| 7,832,917 | B2 | 11/2010 | Chien | |
| 2002/0036902 | A1 * | 3/2002 | Lynch et al. | 362/166 |
| 2007/0029949 | A1 * | 2/2007 | Null et al. | 315/308 |
| 2011/0062888 | A1 * | 3/2011 | Bondy et al. | 315/294 |

OTHER PUBLICATIONS

Ku, Shiao-Tsun et al., co-pending U.S. Appl. No. 13/835,934, filed Mar. 15, 2013 entitled "Programmable Floodlight With Nightlight Feature," and having common inventors and assignee with the present application.

U.S. Patent and Trademark Office, Office Action issued Jul. 17, 2014 in co-pending U.S. Appl. No. 13/835,934, filed Mar. 15, 2013 entitled "Programmable Floodlight With Nightlight Feature," and having common inventors and assignee with the present invention.

* cited by examiner

*Primary Examiner* — Anh Tran
(74) *Attorney, Agent, or Firm* — Patzik, Frank & Samotny Ltd.

(57) ABSTRACT

A user-programmable, motion-activated fixture application having floodlights, a nightlight or wall wash light, and a user-interface having dedicated pushbuttons for time, sensitivity, and timer functionality selection by the user. Two proximity sensors detect the presence of infrared-emitting bodies both in front of and below the sensor housing. An ambient light sensor is employed to determine whether it is presently daytime or nighttime, and to identify transitions between the two. A linear array of display LEDs is shared among the time, sensitivity, and timer switches, showing the current setting selected by the user with as each switch is depressed.

9 Claims, 12 Drawing Sheets

PROGRAMMABLE FLOODLIGHT WITH PUSHBUTTON CONTROL

BACKGROUND OF THE INVENTION

1. Field of the Invention

The present invention relates, in general, to light fixtures and, more particularly, to motion activated floodlight fixtures.

2. General Background of the Invention

Floodlight fixtures are known, and are commonly employed in home and business settings for both safety and security purposes. One type of floodlight fixture incorporates proximity sensing technology, in order to switch on the floodlights when an object is detected in the proximity of the unit.

As in many other technologies, it is desirable to provide the user with a degree of flexibility over the manner of operation of floodlight fixtures through user-settable features, which may lead to relatively complex controls, indicators, and user interfaces. As a result, many existing floodlight fixtures can be relatively difficult for the user to program, and/or employ a relatively complex set of switches and displays in order to achieve a higher degree of user programmability.

Moreover, while floodlight fixtures work well at providing a relatively high degree of illumination for safety and security purposes, among others, it is often not necessary to provide such significant quantities of illumination.

Accordingly, it is an object of the present invention to provide a highly programmable lighting fixture.

It is another object of the present invention to provide a programmable lighting fixture having a user controls that are relatively easy to operate.

It is another object of the present invention to provide a programmable lighting fixture having pushbutton user controls.

It is another object of the present inventions to provide a programmable lighting fixture having a status display that is shared among several different functions.

It is another object of the present invention to provide a lighting fixture with an auxiliary nightlight.

It is another object of the present invention to provide a lighting fixture with an auxiliary nightlight that is actuated in a manner that compliments the operation of associated floodlights.

These and other objects and features of the present invention will become apparent in view of the following specification, drawings and claims.

BRIEF SUMMARY OF THE INVENTION

The present invention comprises a user-programmable, motion-activated fixture application having floodlights, a nightlight or wall wash light, and a user interface incorporating dedicated pushbuttons for time, sensitivity, and timer functionality selection. Two proximity sensors detect the presence of infrared-emitting bodies both in front of and below the sensor housing. An ambient light sensor is employed to determine whether it is presently daytime or nighttime, and to identify transitions between the two. A linear array of display LEDs is shared among the time, sensitivity, and timer switches, showing the current setting selected by the user with as each switch is depressed.

A microcontroller disposed within a controller housing governs the overall operation of the unit. In a sensing operation, the microcontroller receives the analog voltage output by the proximity sensors, converts the analog voltage to a digital value, and compares the digital value to predetermined thresholds of sensitivity, depending upon whether the user has selected minimum, normal, or boost sensitivity. The microcontroller also receives the analog output from an ambient light sensor, converts the analog voltage to a digital value, and compares the digital value to pre-stored values associated with the transitions from night to dawn, and from dusk to night. The microcontroller further samples the current position of three momentary pushbutton switches permitting the user to select among various time, sensitivity, and timer settings for the unit. As outputs, the microcontroller issues a signal to turn on or off a series of linearly-arranged LEDs that are user-adjustable in position, and that serve as a nightlight/wall wash illuminators. In general, the nightlight LEDs are deactivated whenever the floodlights are in operation, either pursuant to a triggering of the proximity sensors, or when activated in 3-hour, 6-hour, or dusk-to-dawn modes of operation. The microcontroller also issues a signal that, via a relay, controls the on-off operation of the floodlights.

DETAILED DESCRIPTION OF THE INVENTION

Figure 1:
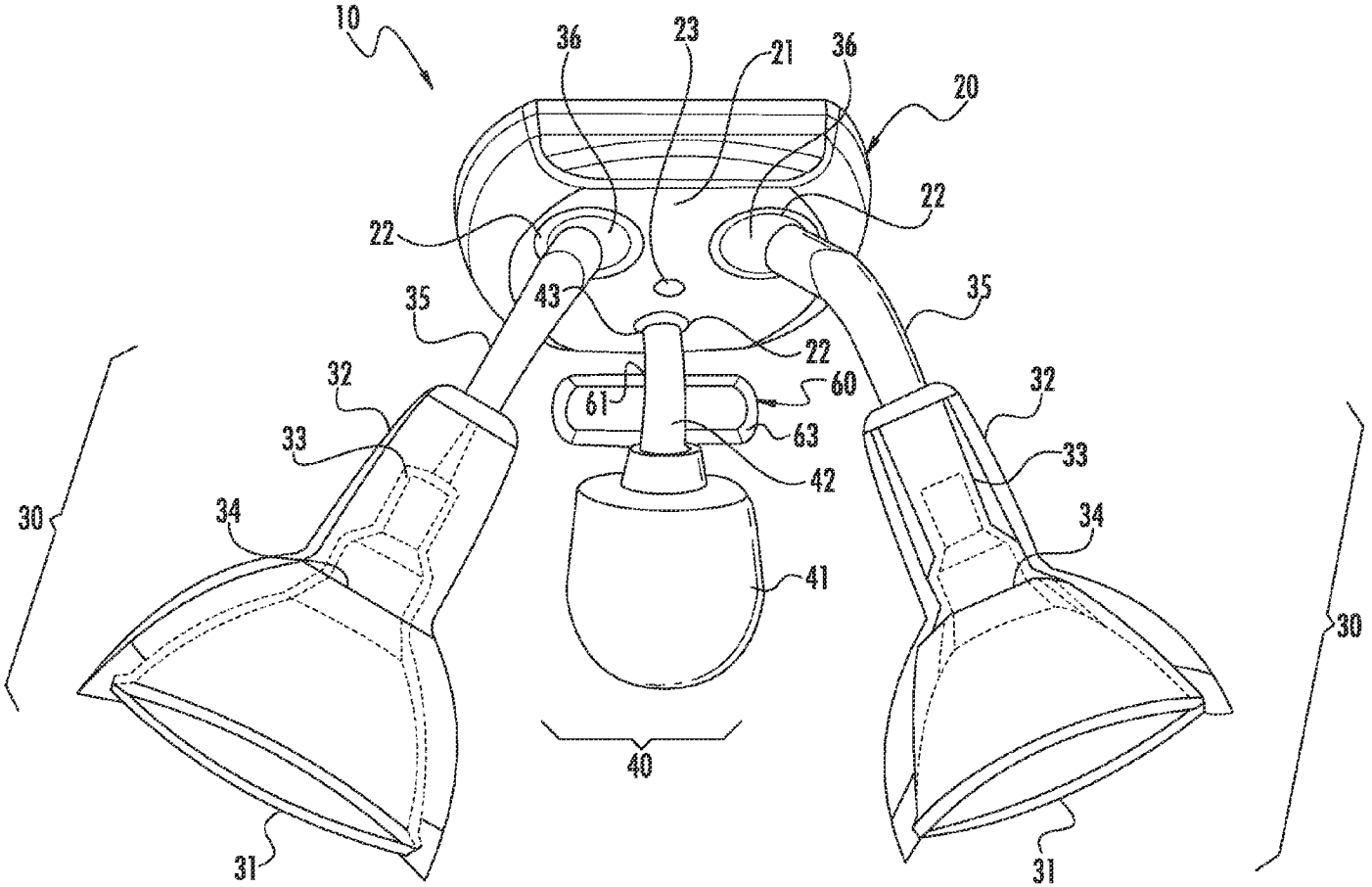
FIG. 1 is an elevated top perspective view of a programmable floodlight of the present invention.

While the present invention is susceptible of embodiment in many different forms, there is shown in the drawings and will herein be described in detail, one specific embodiment, with the understanding that the present disclosure is intended as an exemplification of the principles of the present invention and is not intended to limit the invention to the embodiment illustrated.

Figure 2:
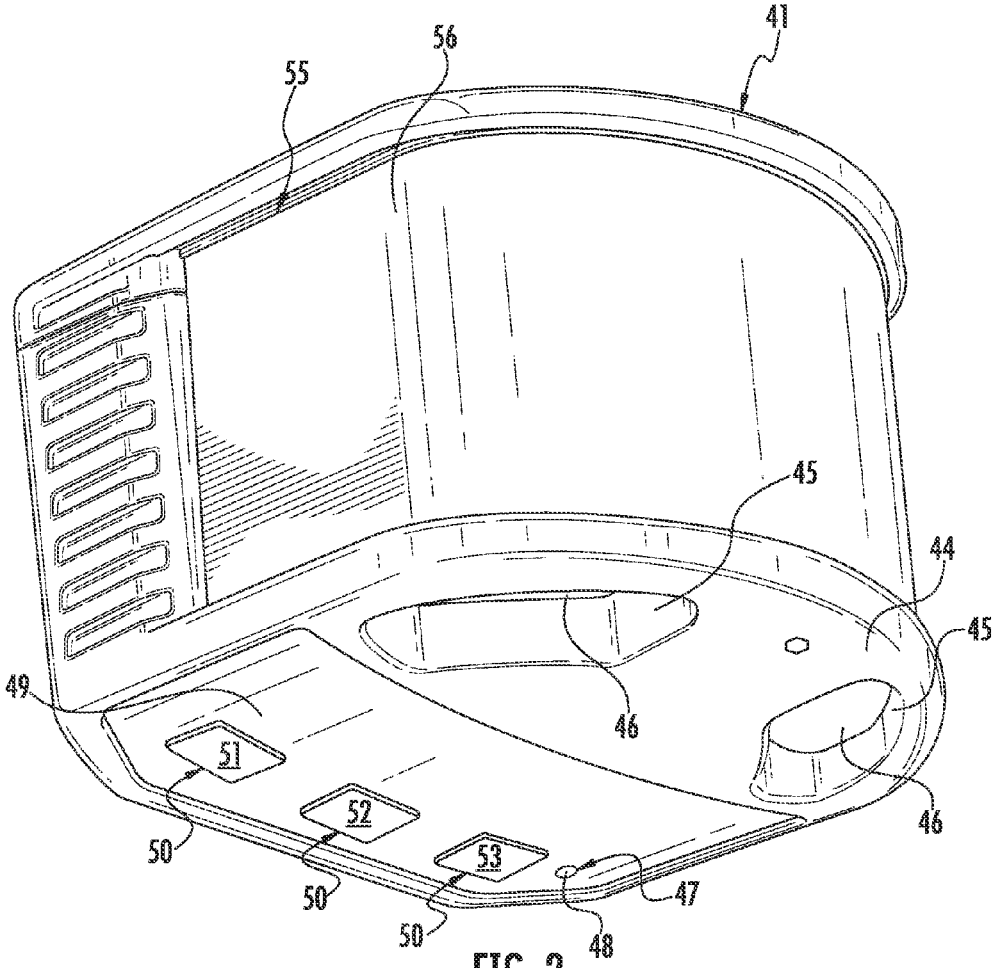
FIG. 2 is an enlarged, bottom perspective view of the control assembly portion of the present programmable floodlight.

Programmable floodlight 10 is shown in FIGS. 1 and 2 as comprising base plate 20, two floodlight assemblies 30, control assembly 40, and wall wash assembly 60. Base plate 20 supports two floodlight assemblies 30, control assembly 40, and wall wash assembly 60, and is further employed to couple programmable floodlight 10 to a source of electrical power, such as a conventional four-inch electrical junction box, and to physically mount programmable floodlight 10 to the junction box or other suitably sturdy structure. As shown in FIG. 1, base plate 20 includes front surface 21 having three sockets 22 extending therethrough, each accepting an associated ball to form three user-manipulable ball-and-socket type joints. Base plate 20 further includes mounting aperture 20 permitting a mounting bolt to be inserted therethrough for threaded engagement with a conventional cross bar associated with a conventional junction box in order to affix programmable floodlight 10 to the junction box. Wall wash assembly 60, and its associated functionality as further described below, may optionally be omitted.

Each floodlight assembly 30 comprises floodlight housing 32, light bulb 31, light bulb socket 33, and floodlight arm 35. Light bulb 31 may comprise an incandescent, compact fluorescent, LED, or other form of replaceable floodlight-sized bulb, and is threadably and releasably coupled to socket 33.

Light bulb socket 33 includes water seal gasket 34 inserted therein to inhibit moisture such as rain, snow, and condensation from entering the interior of socket 33. Water seal gasket 34 may be constructed of a silicone or other resilient material. Floodlight arm 35 couples floodlight housing 32, which surrounds light bulb 31 and socket 33, to base plate 20 via ball end 36, which cooperates with an associated socket 22 to form a ball-and-socket joint, permitting floodlight arm 35 and, in turn, floodlight assembly 30 overall, to be moved and rotated relative to base plate 20 into any of a wide variety of possible positions, permitting the user to aim the light emitted by light bulb 31 in a desired direction.

Control assembly 40 is shown in FIG. 1 as comprising housing 41, which may be constructed of oriented polypropylene ("OPP") or another suitable plastic material, and control arm 42. Control arm 42 couples housing 41 to base plate 20 via ball end 43, which cooperates with an associated socket 22 to form a ball-and-socket joint, permitting control arm 42 and, in turn, housing 41, to be moved and rotated relative to base plate 20 into any of a wide variety of possible positions, as desired to conveniently access user controls disposed on a surface of housing 41, and to aim an ambient light sensor contained with housing 41 in a generally downward direction. Control assembly 40 contains one or more printed circuit cards, having a power supply for the overall unit and sensor and control circuitry that govern the operation of both the floodlights and nightlight illumination.

Wall wash assembly 60 is shown in FIG. 1 as comprising housing 63, which may be constructed of OPP or another suitable plastic material, and wall wash arm 61. Wall wash arm 61 couples housing 63 to base plate 20 via a ball disposed at one end of wash arm 61, cooperating with an associated socket 22 to form a ball-and-socket joint, permitting wall wash arm 61, and, in turn, housing 63, to be moved and rotated relative to base plate 20 into any of a wide variety of possible positions, as desired to aim light emitted through a lens disposed on the bottom surface of housing 63 in order to illuminate, or wash with LED light emitted from housing 30, a desired portion of a wall or other surface to which base plate 20 and, in turn, the remainder of programmable floodlight 10 is attached. In general, the wall wash or nightlight LEDs are operated from dusk to dawn (when enabled by placing the timer setting in off, 3-hour, or 6-hour mode, as described further below), although they are turned off during periods of floodlight activation in response to a triggering of the unit's proximity sensors. Housing 63 contains a printed circuit board containing a linear array of wall wash Light Emitting Diodes, collectively emitting light through the lens disposed on the bottom surface of housing 63. The lens may be constructed of high-density polyethylene or another suitable transparent or translucent material.

As shown in FIG. 2, control housing 41 comprises bottom surface 44, having two bottom proximity sensor apertures 45 extending therethrough. Translucent lenses 46, may both be constructed of high-density polyethylene ("HDPE") or another suitable material, provide a protective cover across sensor apertures 45 while, at the same time, permit infrared light waves, such as those generated by the human body, to pass through sensor apertures 45 to the interior of control housing 41, where two pyroelectric infrared ("PIR") sensors are disposed. As a result, the PIR sensors are generally capable of sensing the presence of infrared-emitting bodies in a region generally below the location where programmable floodlight 10 is installed. Bottom surface 44 further includes ambient light sensor aperture 47 extending therethrough and covered by lens 48, which likewise may be constructed of HDPE or another suitable transparent or translucent material, providing a protective cover across ambient light sensor aperture 47 while, at the same time, permitting ambient visible light to pass through aperture 47 to the interior of control housing 41, where a cadmium sulfide ambient light sensor is disposed for determining, in general, whether it is presently daytime or nighttime in order to govern the operation of the floodlights and wall wash LEDs.

Bottom surface 44 of control housing 41 further includes the actuator portions of three user-depressible, momentary, normally-open pushbutton switches, namely time switch 51, sensitivity switch 52, and timer switch 53. Overlay film 49 is affixed to a portion of bottom surface 44 of control housing 41 using a suitable adhesive, and includes indicia printed thereon, including indicia 50 indicative of the functions performed by time switch 51, sensitivity switch 52, and timer switch 53. Overlay film may further include legend information, including the depictions of LED status light values associated with the operation and current functional setting of each of time switch 51, sensitivity switch 52, and timer switch 53, as illustrated in Table 1 below. Moreover, ambient light sensor lens 48 may be integrally formed with and comprise a portion of overlay film 49, which further serves as a protective cover over the actuator portions of time switch 51, sensitivity switch 52, and timer switch 53.

Control housing 41 further includes arcuate front aperture 55, covered by translucent lens 56, which may be constructed of HDPE or another suitable material, providing a protective cover across front apertures 45 while, at the same time, permit infrared light waves, such as those generated by the human body, to pass through front aperture 55 to the interior of control housing 41, where two PIR sensors are disposed at approximately 45° opposing angles away from either side of a hypothetical plane bisecting control housing into two equally sized halves, as viewed from the front of control housing 41. As a result of this orientation of the PIR sensors relative to front aperture 55, programmable floodlight 10 is capable of sensing the presence of infrared-radiating bodies across an arc of approximately 270°, relative to the front center portion of aperture 55.

Figure 3:
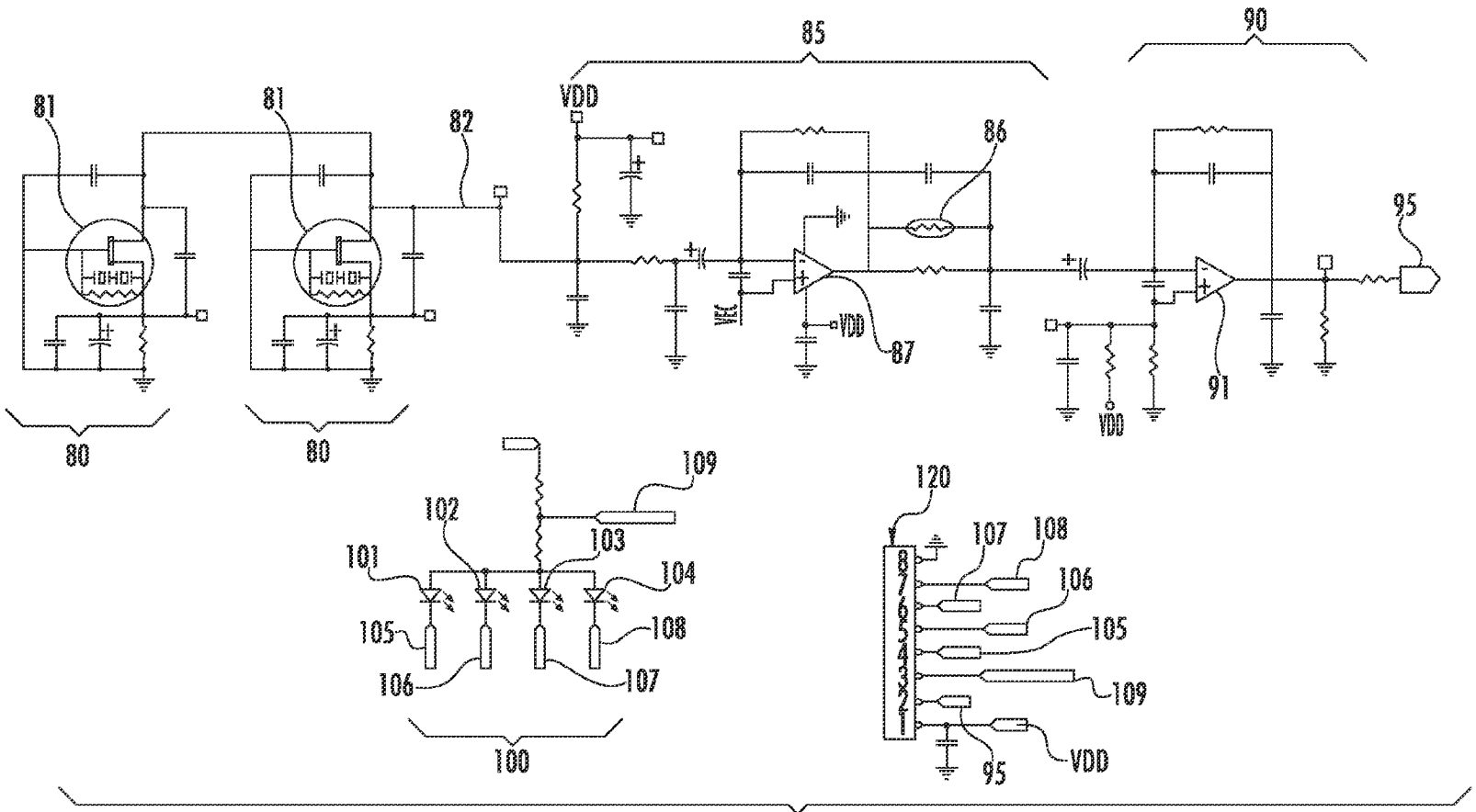
FIG. 3 is a schematic diagram of the proximity sensing and display portions of the present programmable floodlight.
Figure 4A:
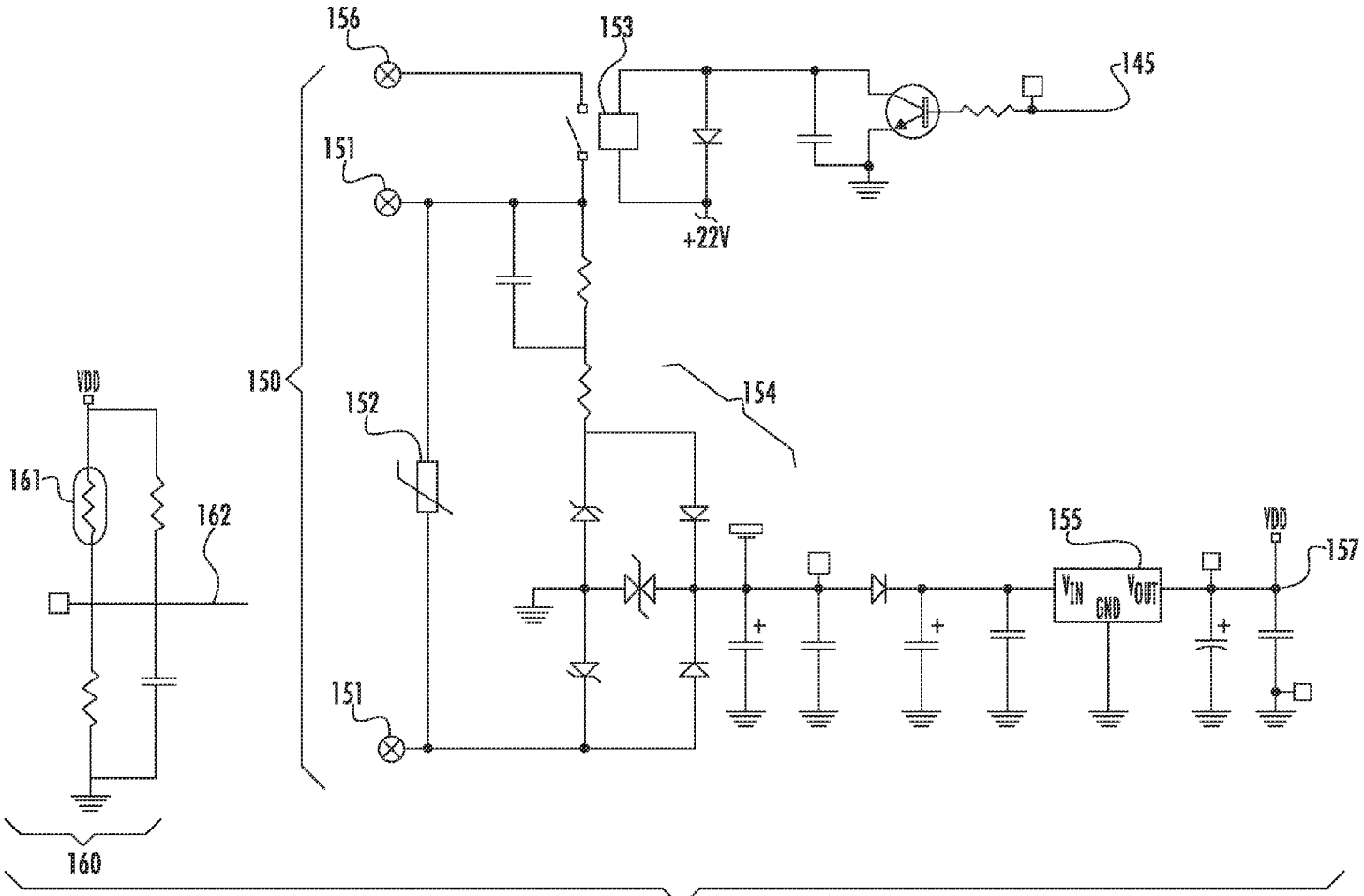
FIGS. 4A and 4B are a schematic diagram of the power supply, ambient temperature sensing, wall wash lighting, and control portions of the present programmable floodlight.
Figure 4B:
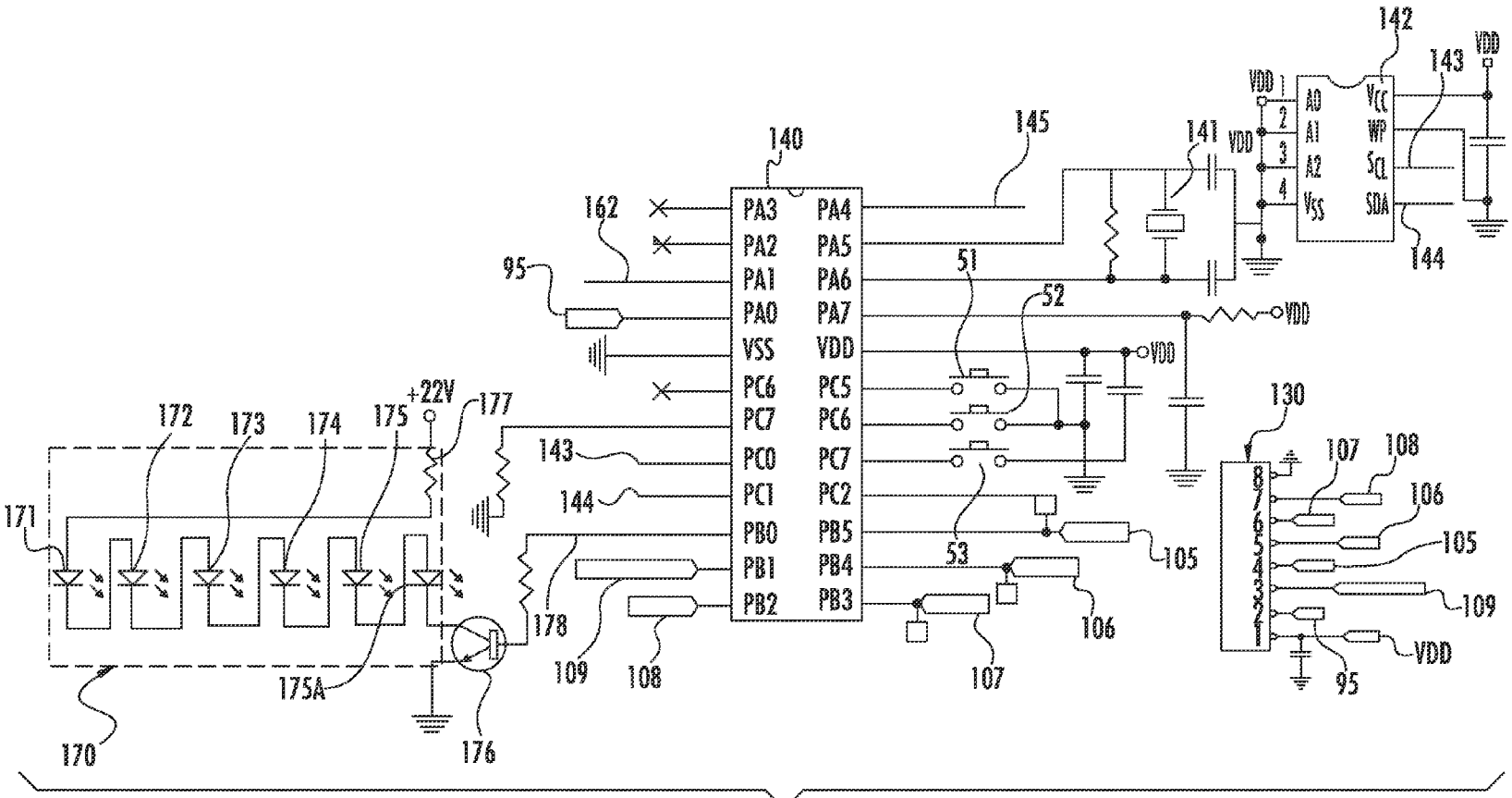

The electronic circuitry housed within the interior of control housing 41 is shown in FIGS. 3 and 4. Referring to FIG. 3, two proximity sensing circuits 80 are provided, each employing a PIR proximity sensor, which may comprise a D204B-type sensor manufactured by Nanyang Senba Optical and Electronic Co. Ltd. of Hong Kong. The outputs of both proximity sensing circuits 80 are tied together in wire-OR fashion to form a collective output signal 82. Signal 82 is input to ambient temperature compensation circuit 85, comprising negative temperature coefficient thermistor 86 and operational amplifier 85, thereby adjusting the analog voltage level of output signal 82, reflecting sensed external infrared radiation received by the PIR sensors through both downward facing apertures 45 and forward facing apertures 55 of housing 41, for the level of ambient temperature of the region immediately surrounding programmable floodlight 10. The output of ambient temperature compensation circuit 85 is fed to active low-pass filter 90, comprising operational amplifier 91, to condition output signal PIR 95 into an analog signal having a voltage indicative of infrared radiation sensed by PIR sensors 81 for sampling and analog-to-digital conversion by a microcontroller within control housing 41.

With continuing reference to FIG. 3, LED display unit 100 comprises four LEDs 101, 102, 103, 104, preferably red in color emission and with each LED being individually switchable between its illuminated and non-illuminated state via a corresponding digital LED control signal, 105, 106, 107, 108, respectively, output from dedicated input/output pins of a microcontroller data port. LED display unit 100 is oriented in a forward-facing manner within control housing 41 such that its four LEDs are collectively displayed as a linear, horizontally-oriented array, visible externally at the front of control housing 41 through lens 56.

Load balancing signal 109, likewise output from the microcontroller, provides a compensation for the quantity of LEDs simultaneously illuminated, in order to provide relatively uniform brightness of each LED, regardless of how many are illuminated at any given time. Connector 120, coupled to a circuit board associated with the circuitry of FIG. 3, permits an associated cable to carry digital logic-level voltage (denoted $V_{dd}$ in FIGS. 3 and 4), ground, LED control signals 105, 106, 107, 108, load balance signal 109, and PIR signal 95 between a first circuit board associated with the circuitry of FIG. 3 and a second circuit board associated with the circuitry of FIG. 4.

Referring to FIG. 4, power supply 150 receives external power, such as (in embodiments of the present invention configured for operation within the United States) 120 volt, single-phase alternating current power via leads 151, which may be coupled to conventional household electrical wiring via a conventional power junction box. Metal oxide varistor 152 is connected in shunt mode across power leads 151 to protect against high transient voltage fluctuations. Rectifier circuit 154, comprising conventional diodes, zener diodes and transient suppression diodes collectively forming a full-wave bridge rectifier, provides a nominal direct current output voltage of approximately 22 volts. This 22 volt source is coupled to voltage rectifier 155 to provide voltage $V_{dd}$, nominally 5 volts, suitable for powering the digital circuitry portions of FIGS. 3 and 4. The 22 volt source is also coupled to one terminal of relay 153, permitting a digital relay control signal 145 output by the microcontroller to control the open or closed state of relay 153 and, in turn, to control whether voltage is applied to switched power lead 156. As switched power lead 156 is coupled to one terminal of sockets 33 of floodlight assemblies 30, this, in turn, permits the microcontroller to turn floodlights 31 on and off as programmed by the user and under software control.

Ambient light sensing circuit 160 comprises cadmium sulfide ("CDS") photoresistor 161, and outputs ambient light signal 162 having an analog voltage indicative of the amount of ambient light reaching CDS photoresistor 161 for sampling and analog-to-digital conversion by a microcontroller within control housing 41.

Microcontroller 140 may comprise an 8-bit reduced instruction set ("RISC") microcontroller having built-in analog-to-digital converters and a real-time clock, such as an HT46R066 microcontroller, manufactured by Holtek Semiconductor Inc. of Taipei, Taiwan. Microcontroller 140 governs the overall operation of the present programmable floodlight 10, including the sampling of the analog output 162 of ambient light sensing circuit 160 and the analog output 95 derived from proximity sensors 81 via input pins of the microcontroller coupled to internal analog-to-digital converters. Microcontroller 140 further controls the individual operation of indicator LEDs 101, 102, 103, and 104 via control signals 105, 106, 107, 108 output from the output pins of an input/output port of microcontroller 140. Microcontroller 140 also controls the on/off operation of floodlights 31, via digital relay control signal 145 output from a data port output pin of microcontroller 140. Microcontroller further controls the simultaneous on/off operation of wall wash LED assembly 170, via by wall wash activation signal 178, output from a data port output pin of microcontroller 140

Wall wash LED assembly 170 comprises a circuit board mounted within the interior of wall wash housing 63 having circuitry including current limiting resistor 177 and six wall wash LEDs 170, 171, 172, 173, 174, 175, and 175A, collectively wired in series and collectively driven by transistor 176 which, in turn, is switched on and off by wall wash activation signal 178. Wall wash LEDs 170, 171, 172, 173, 174, 175, and 175A are mounted to a printed circuit board within wall wash housing 63 in a linear orientation such that relatively uniform illumination is emitted through a lens extending across a bottom surface of wall wash housing 63.

Connector 130, coupled to a circuit board associated with the circuitry of FIG. 4, permits an associated cable to carry digital voltage $V_{dd}$, ground, LED control signals 105, 106, 107, 108, load balance signal 109, and PIR signal 95 between a first circuit board associated with the circuitry of FIG. 3 and a second circuit board associated with the circuitry of FIG. 4.

As shown in FIG. 4, each of time switch 51, sensitivity switch 52, and timer switch 53 are each coupled on one of their terminals to a logic ground signal, and, on the other terminal, to a dedicated input pin of an input port of microcontroller 140. As a result, when sampling an associated input port, Microcontroller senses a logic "one" at a position of the data port whenever an associated switch 51, 52, 53 is in its normally open orientation, due to the presence of dedicated internal pull-up resistors at each input port pin of microcontroller 140, and a logic "zero" at the same position of the data port whenever an associated switch is closed by manual depression of an associated actuator portion by the user.

Crystal oscillator 141 provides an external timebase for clocking the regular, periodic cycles of operation of microcontroller 140. Memory integrated circuit 142, which may comprise an electrically erasable programmable read-only memory (EEPROM), such as an HT24LCO2 memory IC manufactured by Holtek Semiconductor Inc. of Taipei, Taiwan, incorporates a 2-wire serial output port, and sequentially outputs all of its preprogrammed data contents one bit at a time via serial data signal 144 in accordance with pulses received via serial clock signal 143. Both serial clock signal 143 and serial data signal 144 are coupled to associated serial clock output and serial data input pins, respectively, of microcontroller 140, enabling microcontroller 140 to "self load" an external program of operational instructions and data upon initial power-up of programmable floodlight 10.

Table 1 below illustrates the manner in which the user may program the present programmable floodlight 10 through sequential operation of time switch 51, sensitivity switch 52, and timer switch 53. Table 1 further illustrates the operational display of LEDs 101, 102, 103 and 104 under the control of microcontroller 140, as the user depresses time switch 51, sensitivity switch 52, and timer switch 53, as sensed by reading associated input ports of microcontroller 140. For each successive actuation of a switch, the four LEDs are advanced to reflect the next associated operational state to the right in the table, in a circular, repeating fashion, for the particular switch currently depressed by the user. In this manner, LEDs 101, 102, 103 and 104 are shared operationally for time mode display, sensitivity mode display, and timer mode display.

TABLE 1

| | LED 101 | LED 102 | LED 103 | LED 104 |
|---|---|---|---|---|
| Time switch 51 | Test Mode | 1 minute | 5 minutes | 20 minutes |
| Sensitivity switch 52 | Minimum (17 ft) | Normal (45 ft) | Boost (70 ft) | |

TABLE 1-continued

| | LED 101 | LED 102 | LED 103 | LED 104 |
|---|---|---|---|---|
| Timer switch 53 | Off | 3 hours | 6 hours | Dusk to dawn |

As indicated above, successive activation time switch 51 is employed to permit the user to control whether the unit is in a test mode of operation, or whether, upon a determination that a PIR sensor 81 has been triggered (and the unit is not in a 3-hour, 6-hour, or dusk to dawn mode), floodlights 31 should be activated for a duration of 1 minute, 5 minutes, or 20 minutes before deactivation. Successive activation of sensitivity switch 52 is employed to permit the user to control the sensitivity of PIR sensors 81—i.e., whether they are to be considered to be triggered if a person or other infrared-radiating object is sensed within a radius of approximately 17 feet of the sensors (minimum mode), 45 feet of the sensors (normal mode), or 70 feet of the sensors (boost mode). Successive activation of timer switch 53 is employed to permit whether the floodlights are to be activated for a period of time after the initial detection of a transition from daylight to nighttime (i.e., dusk), or whether they are to be activated in response to a triggering of the PIR sensors. Specifically, the user may select between an off timer setting, where the floodlights operate in response to the triggering of the PIR sensors; a 3-hour setting, where the floodlights are activated for a three hour duration following the initial detection of dusk; a 6-hour setting, where the floodlights are activated for a six hour duration following the initial detection of dusk; and a dusk to dawn setting, wherein the floodlights remain activated from the initial detection of dusk until a subsequent detection of a transition from nighttime to daylight (i.e., dawn).

A flowchart 200 illustrating the major operations performed by microcontroller 140 as it executes its predetermined programming is shown in FIGS. 5A through 5G.

Figure 5A:
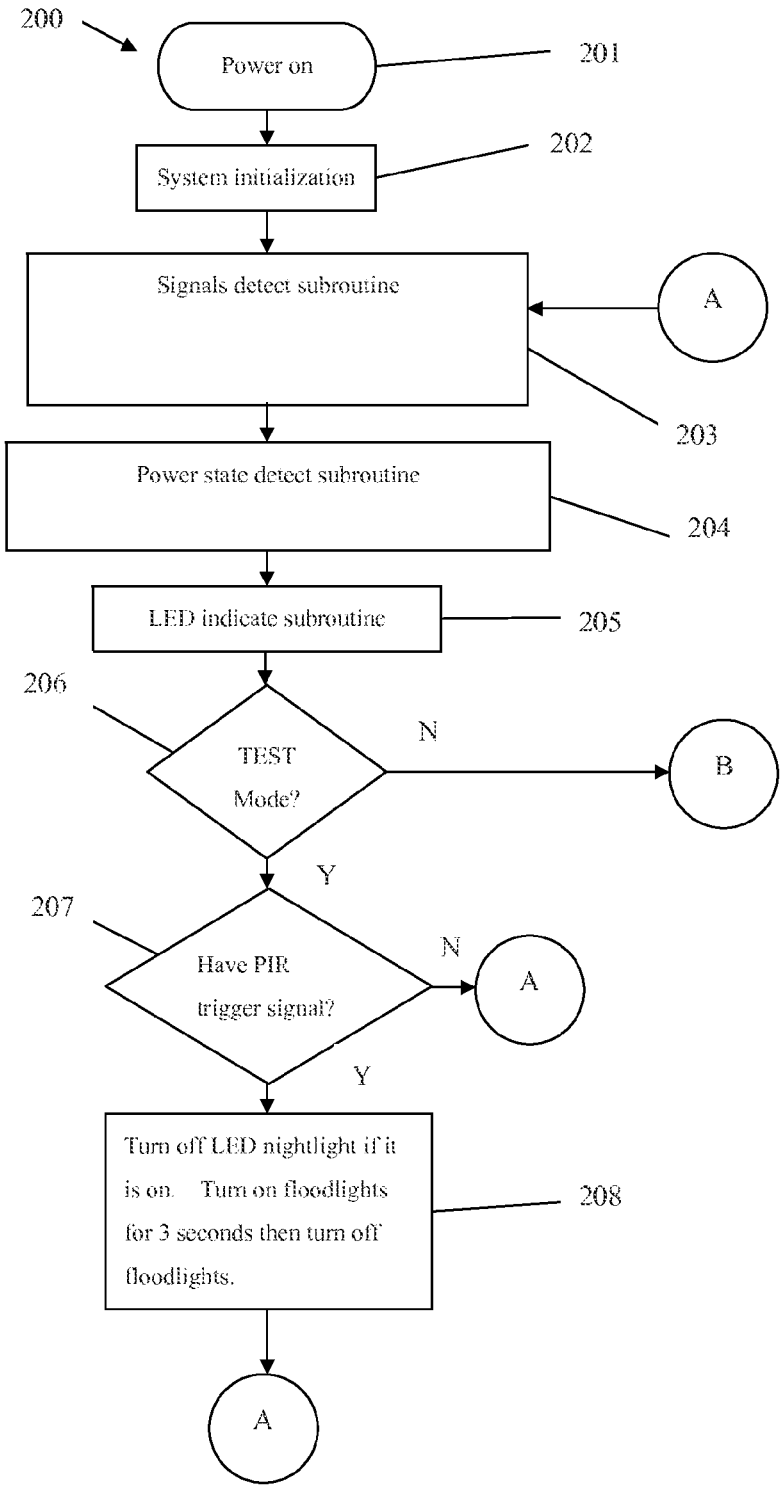
FIG. 5A through 5G is a flowchart of certain operations performed by the control portion of the present programmable floodlight.

Referring to FIG. 5A, upon the application of power in step 201 (i.e., when the unit is first connected to a source of power, or whenever an externally switched source of power is applied to the unit), microcontroller 140 loads its programming instructions and associated data externally from serial EEPROM 142, and transitions to step 202 to begin general system initialization functions.

In step 202, an initial warm-up period of approximately ninety seconds is entered. During this period, floodlights 31 are momentarily activated, and LEDS 101, 102, 103, and 104 are repeatedly cycled in a manner simulating back-and-forth motion.

Next, in step 203, microcontroller 140 executes a signal detection subroutine. During the execution of this subroutine, PIR signal 95, reflecting the temperature-compensated, amplified and filtered output of proximity sensors 81, is sampled and converted to a digital value via an analog-to-digital converter within microcontroller 140. Analog output 162 of ambient light sensing circuit 160 is likewise sampled and converted to a digital value via an analog-to-digital converter within microcontroller 140. Moreover, in step 203, each of pushbutton switches 51, 52, and 53 is sampled at a data port of microcontroller 140 in order to determine whether any switch has been depressed by a user and, if so, the current associated floodlight activation duration setting (test mode, 1 minute, 5 minutes, or 20 minutes), proximity sensor sensitivity setting (minimum, normal, or boost), or timer activation mode setting (off, 3 hours, 6 hours, or dusk to dawn) is updated as necessary to indicate the current user selection following any depression of time switch 51, sensitivity switch 52, or timer switch 53.

Next, in step 205, an LED indication subroutine is executed to update the on/off status of each of LEDs 101, 102, 103 and 104, to reflect any change as directed by a user pushbutton activation that is sensed in step 204.

In step 206, microcontroller 140 performs a test to determine whether, via a user input selection via time switch 51, or by default upon initial power-up, the system is currently in a test mode of operation. If not, transition is taken to step 209 via connector B of flowchart 200. Otherwise, transition is taken to step 207, where microcontroller performs a test to determine, in accordance with the current user-selected sensitivity setting, whether the proximity detectors should be considered to be in a triggered state. If not, transition is taken back to step 203 via connector A. Otherwise, transition is taken to step 208, where the nightlight LEDs are deactivated, and the floodlights are momentarily activated for a three second duration upon initial entry into the test mode of operation.

Figure 5B:
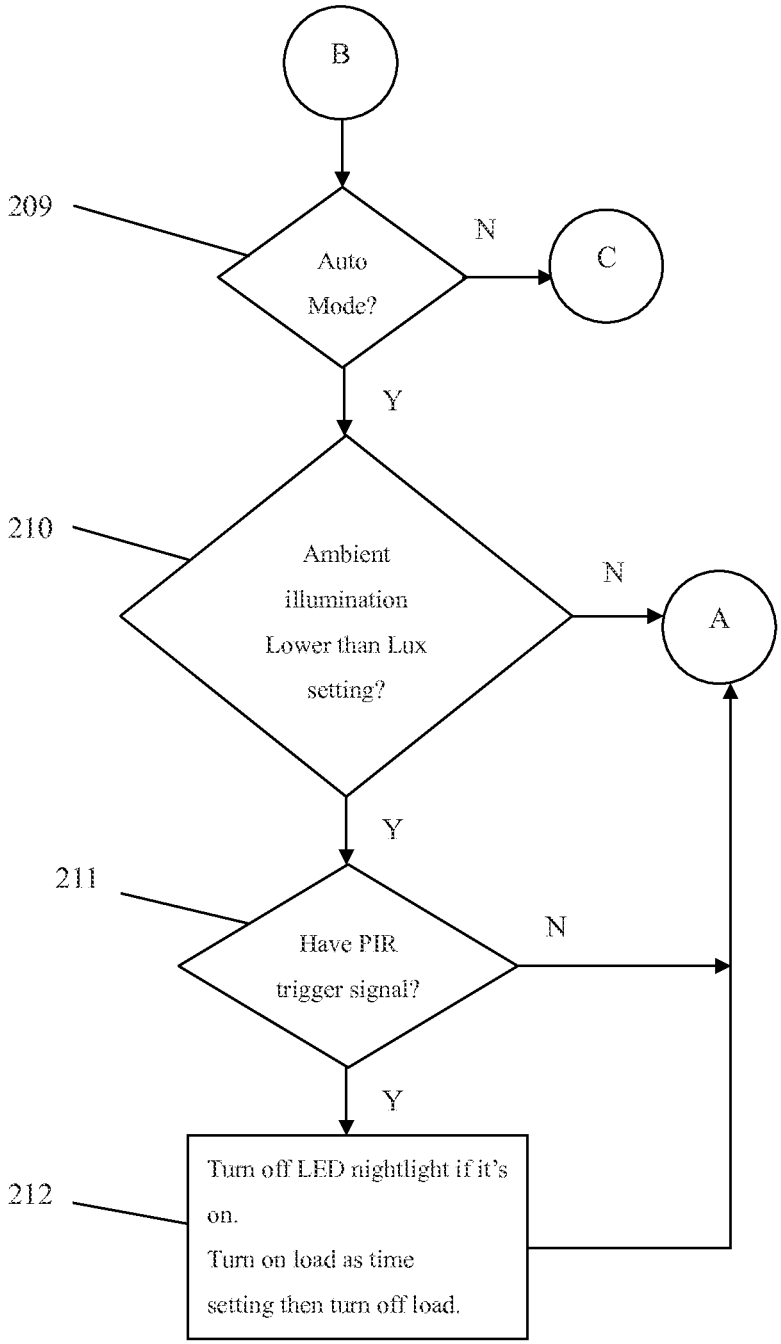

Referring to FIG. 5B, in step 209, microcontroller 140 performs a test to determine if the unit is currently in auto mode (i.e., the user has placed the timer mode off, and not in a dusk to dawn, six hour, or three hour timer mode). In this mode, Microcontroller 140 will maintain the nightlight in an activated state whenever daylight is detected upon sampling the ambient light sensor and the proximity sensor has not been triggered. If in auto mode, transition is taken to step 210, otherwise transition is taken to step 213 of FIG. 5C via connector A. In step 210, microcontroller 140 compares the level of ambient light, as sensed by CDS sensor 161 and sampled and converted to a digital value in step 203, to a predetermined lux (i.e., luminous flux per unit area) threshold value. If the sensed ambient light level is less than the predetermined lux threshold, it is determined to be dusk or evening time, and transition is taken to step 211. Otherwise, transition is taken back to step 203 of FIG. 5A via connector A. In step 211, microcontroller compares the previously digitized value of analog output 95 derived from proximity sensors 81, to the currently active one of three predetermined threshold levels associated with the minimum, normal and boost sensitivity setting previously selected by the user. If the threshold is not exceeded, the nightlight/wall wash LEDs are activated (or remain activated) by microcontroller 140, and transition is taken back to step 203 of FIG. 5A via connector A. Otherwise, transition is taken to step 212, where microcontroller 140 outputs signal 145 to cause floodlights 31 to be illuminated, and sets a countdown timer to the current user-established timer setting (1 minute, 5 minutes, 20 minutes), in order to turn off the lights after the selected duration has expired, and, simultaneously with the expiration of the countdown timer, to reactive the nightlight LEDs. At the same time, the microcontroller turns off the nightlight LEDs (if previously in operation) for the duration that the floodlights are activated. Transition is taken back to step 203 of FIG. 5A via connector A.

Figure 5C:
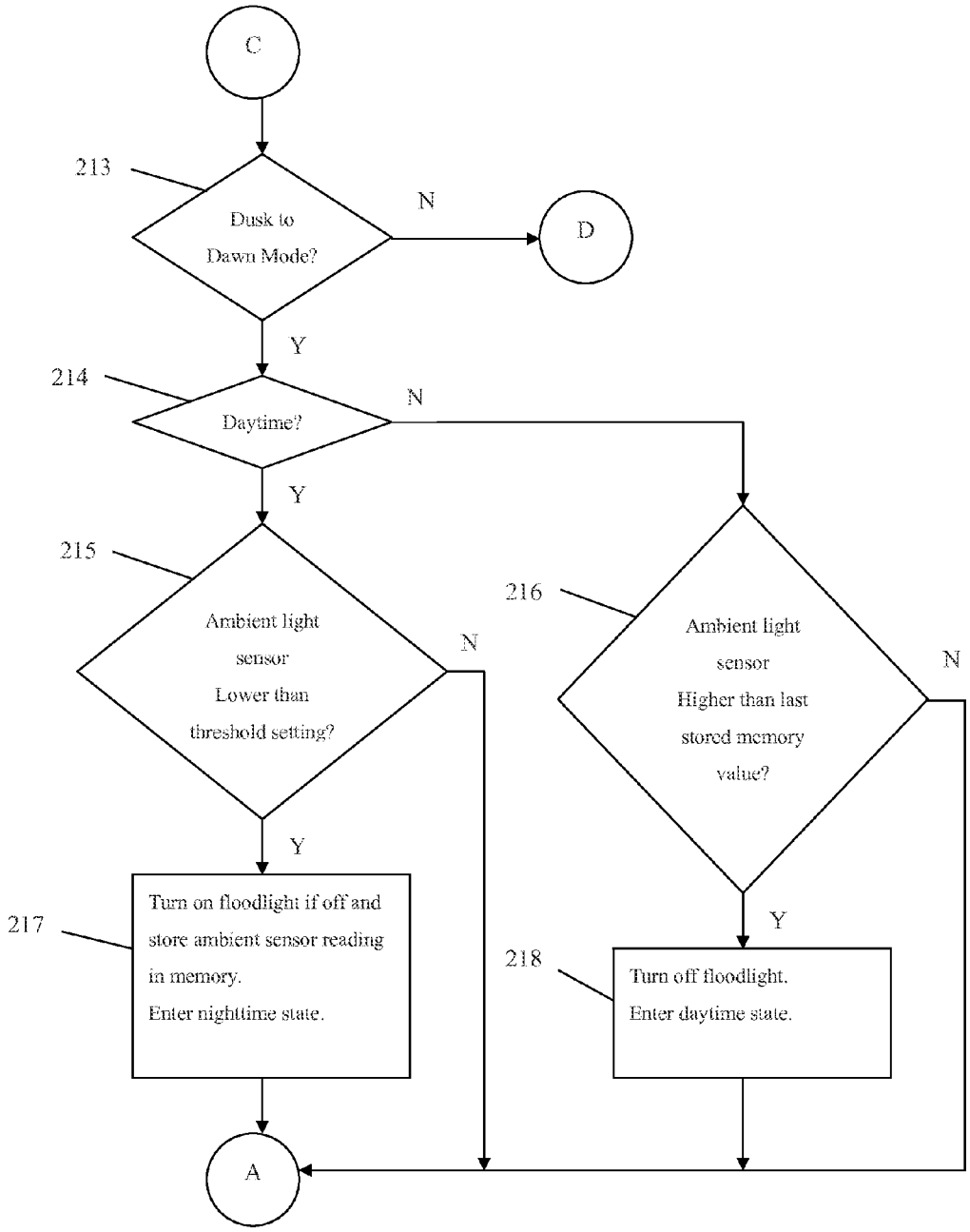

Referring to FIG. 5C, in step 213, microcontroller determines whether the user has placed the unit into dusk to dawn mode via operation of timer switch 53. If not, transition is taken to step 219 of FIG. 5D via connector D. Otherwise, transition is taken to step 214, where microcontroller 140 determines if it is currently daytime, as determined by a flag, or predetermined memory location previously being set as a result of prior sampling and analog-to-digital conversion of the output of the ambient light sensor, and the comparison of the sampled value to a predetermined range of values corresponding to daylight illumination. If so, transition is taken to step 215, otherwise, transition is taken to step 216. In step 215, the microcontroller compares the most recent digital value derived from the ambient light sensor to a predetermined lux threshold indicative of daylight light levels. If the measured ambient light level is higher than the threshold, it continues to be daylight, and transition is taken back to step 203 of FIG. 5A via connector A. Otherwise, dusk is deemed to have begun, and transition is taken to step 217, where the microcontroller turns on the floodlights (if currently deactivated), stores the measured ambient illumination level in memory, and sets a flag indicating that the unit is currently in a nighttime state. Transition is then taken back to step 203 of FIG. 5A via connector A. In step 216, the microcontroller compares the most recent digital value derived from the ambient light sensor to the memory location in which a measured ambient illumination level was previously stored in step 215. If the current ambient light measurement does not exceed the value previously stored in memory, transition is taken back to step 203 of FIG. 5A via connector A. Otherwise, dawn is deemed to have begun, and transition is taken to step 218, where the microcontroller turns off the floodlights and sets a flag indicating that the unit is currently in a daylight state. Transition is then taken back to step 203 of FIG. 5A via connector A.

Figure 5D:
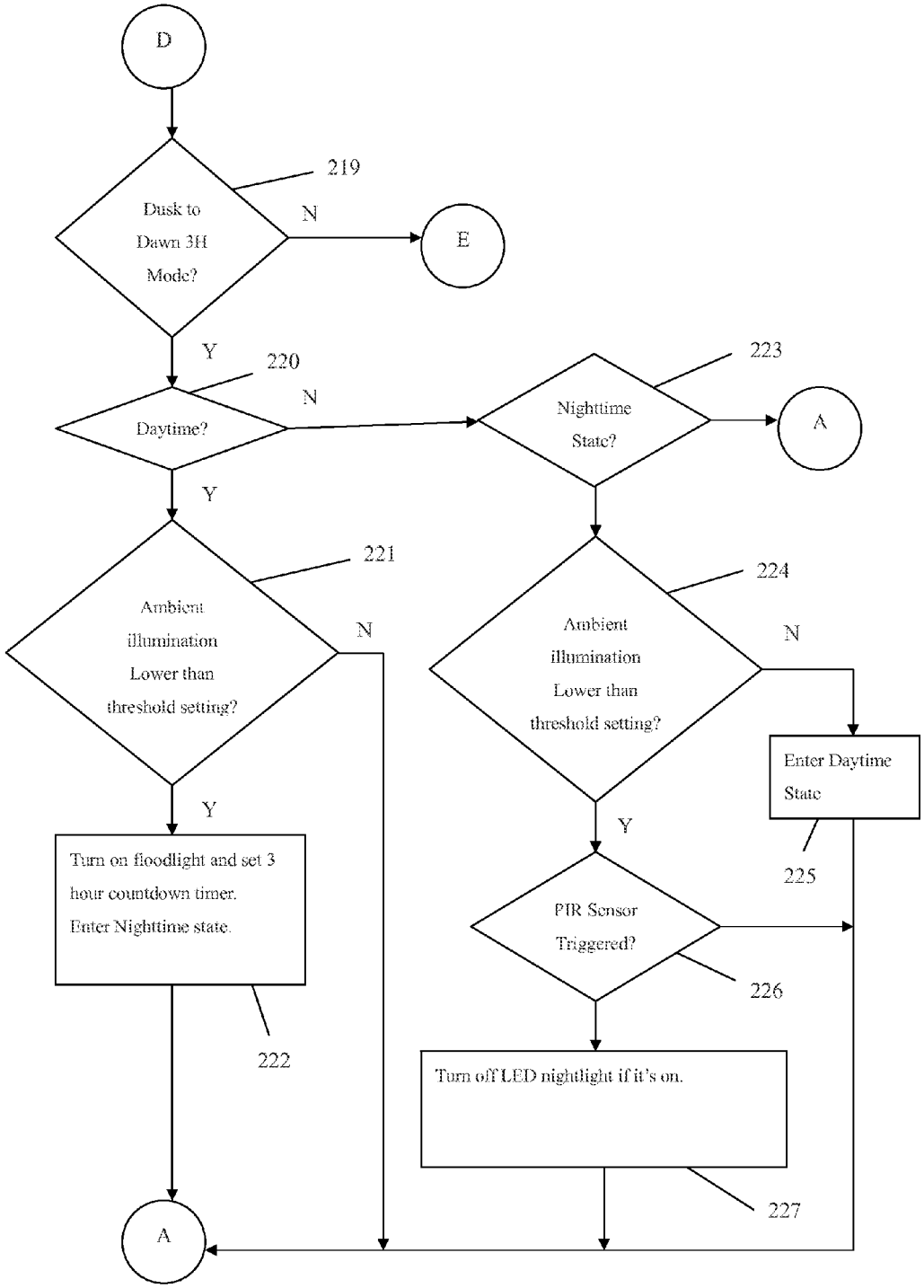

Referring to FIG. 5D, in step 219, microcontroller 140 determines whether the user has placed the unit into a 3 hour timer mode via operation of timer switch 53. If not, transition is taken to step 228 of FIG. 5E via connector E. Otherwise, transition is taken to step 220, where microcontroller 140 determines if it is currently daytime, as determined by a flag previously being set as a result of prior sampling and analog-to-digital conversion of the output of the ambient light sensor. If so, transition is taken to step 221, otherwise, transition is taken to step 223. In step 221, the microcontroller compares the most recent digital value derived from the ambient light sensor to a predetermined lux threshold indicative of daylight light levels. If the measured ambient light level is higher than the threshold, it continues to be daylight, and transition is taken back to step 203 of FIG. 5A via connector A. Otherwise, dusk is deemed to have begun, and transition is taken to step 222, where the microcontroller turns on the floodlights (if currently deactivated), stores the measured ambient illumination level in memory, and sets a flag indicating that the unit is currently in a nighttime state. Transition is then taken back to step 203 of FIG. 5A via connector A. In step 223, microcontroller 140 determines if a flag indicating that the unit is currently in a nighttime state has been set. If not, and transition is taken back to step 203 of FIG. 5A via connector A. Otherwise, transition is taken to step 224, where the microcontroller compares the most recent digital value derived from the ambient light sensor to a predetermined lux threshold indicative of daylight light levels. If the current ambient light measurement is lower than the lux threshold, it continues to be nighttime, and transition is taken to step 226. Otherwise, dawn is deemed to have begun, and transition is taken to step 225, where a flag is set to place the unit into daylight mode, and transition is then taken back to step 203 of FIG. 5A via connector A. In step 226, a test is performed to determine if the proximity sensor has been triggered, in view of the most recent sampling measurement and the specific sensitivity setting entered by the user. If not, and transition is taken back to step 203 of FIG. 5A via connector A. Otherwise, transition is taken to step 227, where microcontroller 140 inhibits signal 178 in order to cause all of the LEDs of wall wash LED assembly 170 to be deactivated (if currently illuminated). Transition is then taken back to step 203 of FIG. 5A via connector A.

Figure 5E:
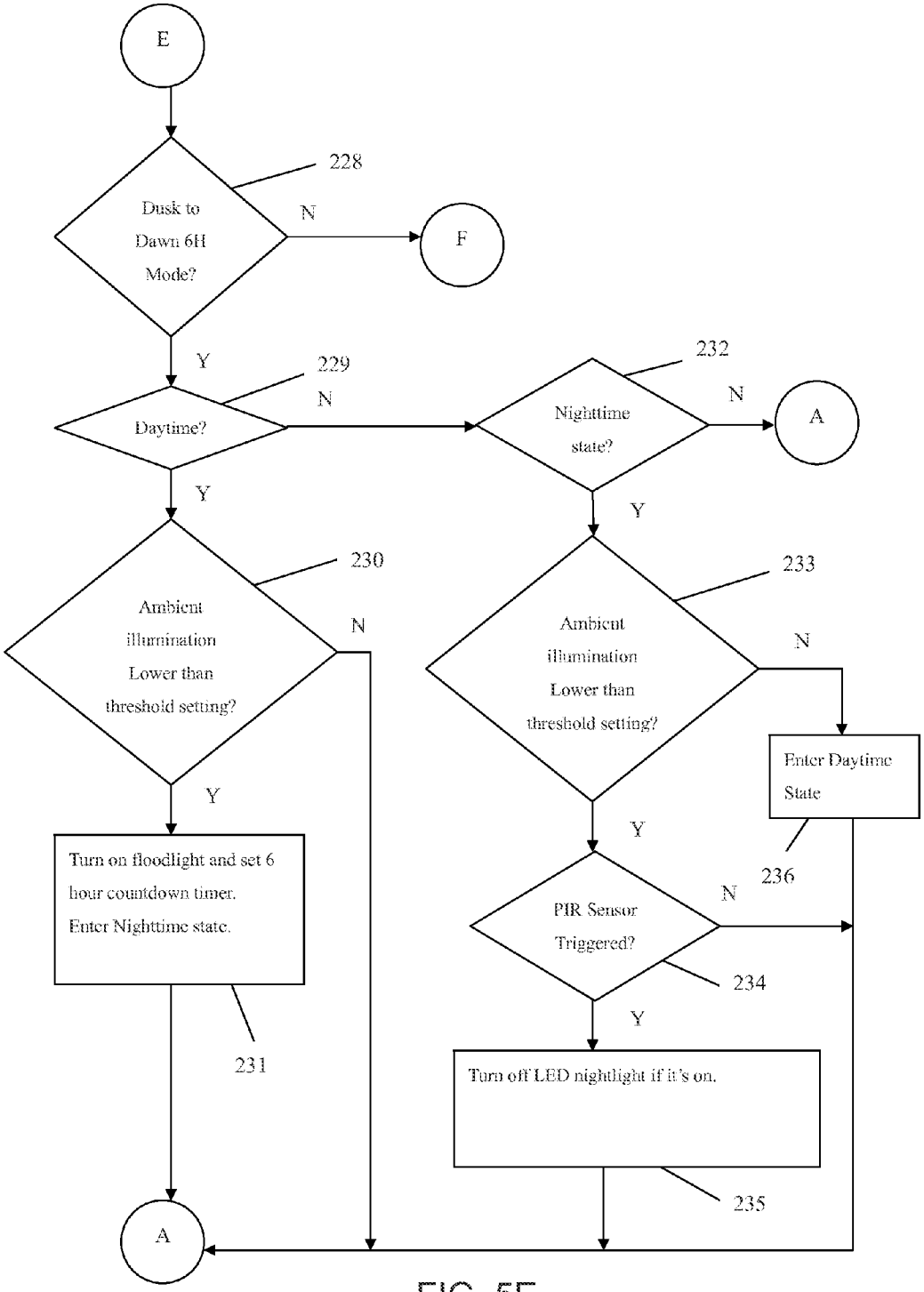

Referring to FIG. 5E, in step 228, microcontroller determines whether the user has placed the unit into a 6 hour timer mode via operation of timer switch 53. If not, transition is taken to step 237 of FIG. 5F via connector F. Otherwise, transition is taken to step 229 where microcontroller 140 determines if it is currently daytime, as determined by a flag previously being set as a result of prior sampling and analog-to-digital conversion of the output of the ambient light sensor. If so, transition is taken to step 230, otherwise, transition is taken to step 232. In step 230, the microcontroller compares the most recent digital value derived from the ambient light sensor to a predetermined lux threshold value indicative of daylight light levels. If the measured ambient light level is higher than the threshold, it continues to be daylight, and transition is taken back to step 203 of FIG. 5A via connector A. Otherwise, dusk is deemed to have commenced, and transition is taken to step 231, where the microcontroller turns on the floodlights (if currently deactivated), stores the measured ambient illumination level in memory, and sets a flag indicating that the unit is currently in a nighttime state. Transition is then taken back to step 203 of FIG. 5A via connector A. In step 232, microcontroller 140 determines if a flag indicating that the unit is currently in a nighttime state has been set. If not, and transition is taken back to step 203 of FIG. 5A via connector A. Otherwise, transition is taken to step 233, where the microcontroller compares the most recent digital value derived from the ambient light sensor to a predetermined lux threshold indicative of daylight light levels. If the current ambient light measurement is lower than the lux threshold, it continues to be nighttime, and transition is taken to step 234. Otherwise, dawn is deemed to have commenced, and transition is taken to step 236, where a flag is set to place the unit into daylight mode. Transition is then taken back to step 203 of FIG. 5A via connector A. In step 234, a test is performed to determine of the proximity sensor has been triggered, in view of the most recent sampling measurement and the specific sensitivity setting entered by the user. If not, and transition is taken back to step 203 of FIG. 5A via connector A. Otherwise, transition is taken to step 235, where microcontroller 140 inhibits signal 178 in order to cause all of the LEDs of wall wash LED assembly 170 to be deactivated (if currently illuminated). Transition is taken back to step 203 of FIG. 5A via connector A.

Figure 5F:
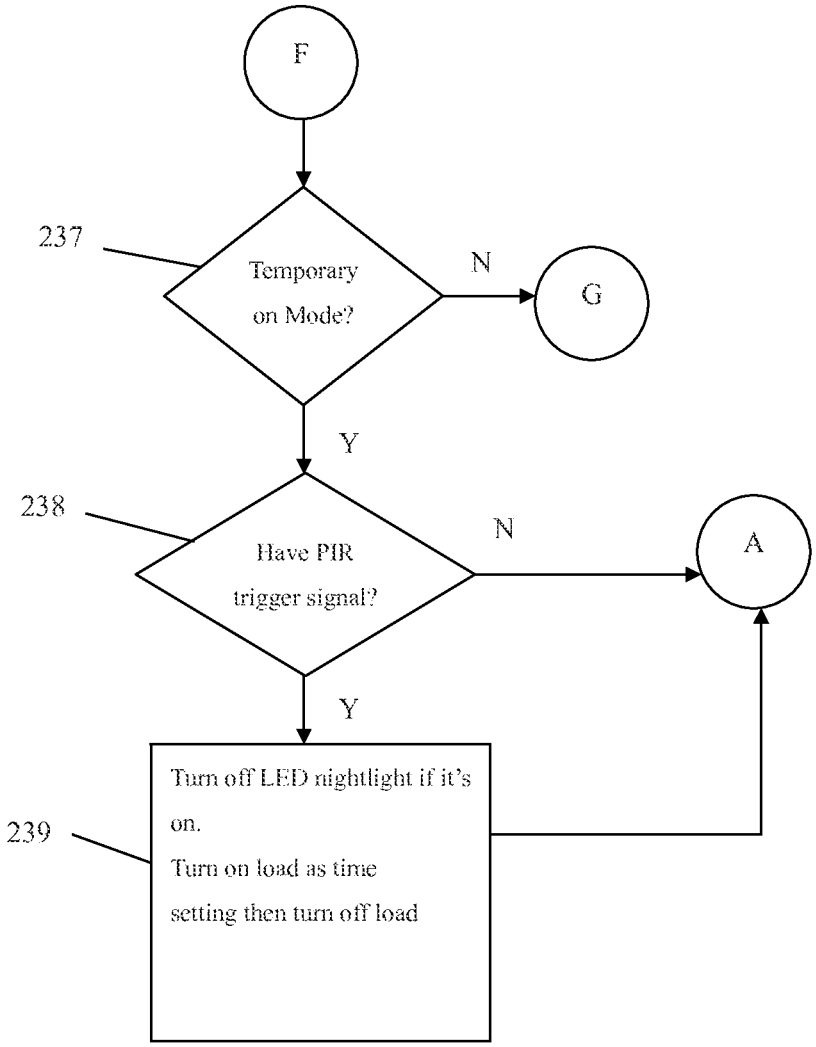

Referring to FIG. 5F, in step 237, microcontroller 140 determines if the unit has been placed into a "temporary on" mode, which may be initiated by the user if the programmable floodlight is coupled to a manually operable wall switch, by rapidly (i.e., within one second or less) turning the switch off and then back on. The resulting momentary decaying of power is sensed by microcontroller 140, which sets an internal flag to indicate that the unit is currently in "temporary on" mode. Once in this mode, the microcontroller activates the floodlights and keeps them activated for the currently programmed time duration (i.e., 1, 5 or 20 minutes). If not in this mode, transition is taken to step 240 of FIG. 5G via connector G. Otherwise, transition is taken to step 238, where a test is performed to determine of the proximity sensor has been triggered, in view of the most recent sampling measurement and the specific sensitivity setting entered by the user. If not, transition is taken back to step 203 of FIG. 5A via connector A. Otherwise, transition is taken to step 239, where microcontroller 140 inhibits signal 178 in order to cause all of the LEDs of wall wash LED assembly 170 to be deactivated (if currently illuminated). Transition is then taken back to step 203 of FIG. 5A via connector A.

Figure 5G:
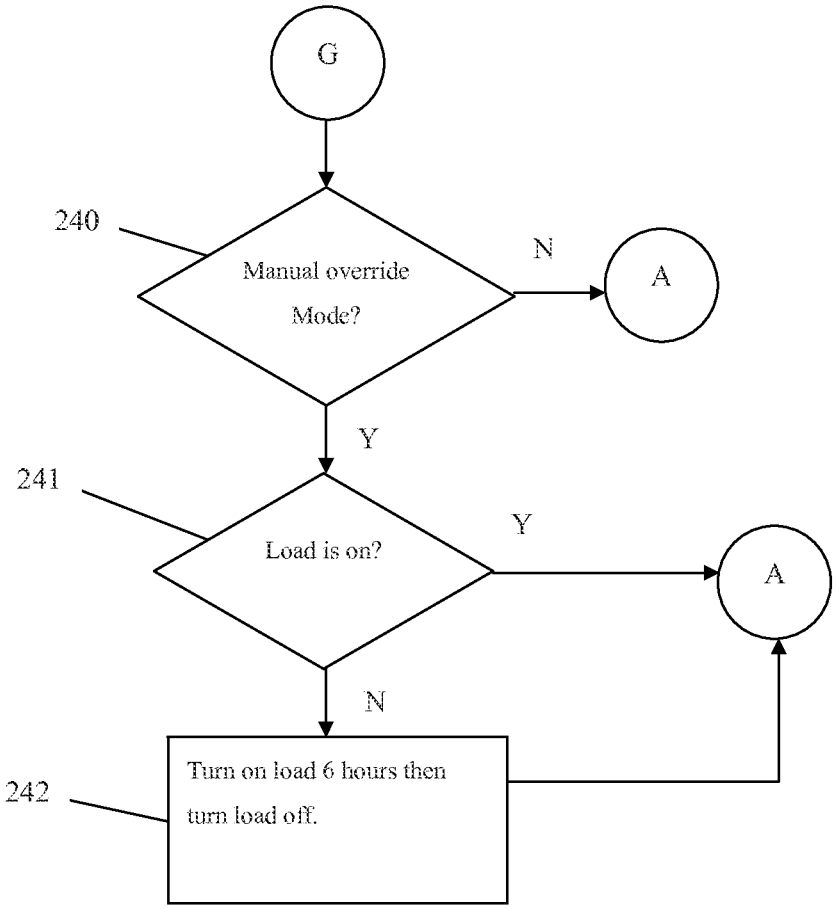

Referring to FIG. 5G, in step 240, microcontroller 140 determines if the unit has been placed into a manual override mode, which may be initiated by the user if the programmable floodlight is coupled to a manually operable wall switch, by rapidly (i.e., within two seconds or less) turning the switch off and then back on two successive times. This momentary cycle of the twice decaying of power and reapplication of power is sensed by microcontroller 140, which sets an internal flag to indicate that the unit is currently in a manual override mode. If not in this mode, transition is taken back to step 203 of FIG. 5A via connector A. Otherwise, transition is taken to step 241, where a test is performed to determine of the floodlights are currently turned on. If so, transition is taken back to step 203 of FIG. 5A via connector A. Otherwise, transition is taken to step 242, where microcontroller 140 where microcontroller activates the floodlights and initiates a six hour countdown timer in order to turn the floodlights off automatically at a later time. Transition is then taken back to step 203 of FIG. 5A via connector A.

Many modifications and variations of the present invention are possible in light of the above teachings. It is therefore to be understood that within the scope of the appended claims, the invention may be practiced other than as specifically described. Various modifications, changes and variations may be made in the arrangement, operation and details of construction of the invention disclosed herein without departing from the spirit and scope of the invention. The present disclosure is intended to exemplify and not limit the invention.

What is claimed is:

1. A light fixture comprising:

at least one light source;

a plurality of user-actuated momentary pushbutton switches including a first momentary pushbutton switch and a second momentary pushbutton switch, each of the at least one user-activated momentary pushbutton switches controlling a different mode of operation of the light fixture;

a display unit having at least two controllable visual indicators including a first visual indicator and a second visual indicator operating in a sequenced manner, each of the visual indicators, when actuated, being associated with a mode of operation of the light fixture; and a controller operably coupled to each of the at least one light source, the plurality of user-actuated momentary pushbutton switches, and the display unit, the controller, upon sensing a closure of any one the plurality of momentary pushbutton switches, changing the mode of operation of the light fixture that is associated with the most recently closed momentary pushbutton switch, consecutive successive closure of either the first or second momentary pushbutton switch causing at least the first and second visual indicators of the display unit to cycle to a successive visual indication corresponding to the change in the current mode of operation of the light fixture that is controlled by the most recently closed momentary pushbutton switch.

2. The invention according to claim 1, wherein the at least one pushbutton switch comprises a time pushbutton switch associated with a timed operation of the light source following a triggering of a proximity sensor, the controller, upon sensing a triggering of the proximity sensor, causing the at least one light source to be activated for a period of time corresponding to a time value selected by successive depression of the time pushbutton switch.

3. The invention according to claim 2, wherein the controller, upon sensing successive depression of the time pushbutton switch, transitions the light source between one minute activation, five minute activation, 20 minute activation, and a test mode of operation.

4. The invention according to claim 1, wherein the at least one pushbutton switch comprises a sensitivity pushbutton switch associated with a proximity sensor sensitivity setting of the light fixture, the controller, upon sampling an output of the proximity sensor, comparing the output of the proximity sensor to a sensitivity value selected by successive depression of the sensitivity pushbutton switch in determining whether or not the proximity sensor is considered to have been triggered.

5. The invention according to claim 4, wherein the controller, upon sensing successive depression of the sensitivity pushbutton switch, transitions the proximity sensor sensitivity setting between values corresponding to about 17 feet, about 45 feet, and about 70 feet in distance from the proximity sensor.

6. The invention according to claim 1, wherein the at least one pushbutton switch comprises a timer pushbutton switch associated with a timed operation of the light source following a perceived transition from daylight to nighttime by the controller upon sampling an ambient light sensor, the controller, upon sensing a voltage output by the ambient light sensor indicative of a transition from daylight to nighttime, causing the at least one light source to be activated for a period of time corresponding to a value selected by successive depression of timer pushbutton switch.

7. The invention according to claim 6, wherein the controller, upon sensing successive depression of the timer pushbutton switch, transitions the light source between three hour, six hour, dusk-to-dawn, and off modes of operation, the off mode of operation being illumination in response to proximity sensor triggering rather than upon a perceived transition of daylight to nighttime.

8. The invention according to claim 1, wherein the light fixture further includes a nightlight and an ambient light sensor, the nightlight and the ambient light sensor being operably coupled to the controller, the controller causing the nightlight to emit light whenever the ambient light sensor emits a signal indicative of nighttime and the controller has not activated the at least one light source.

9. The invention according to claim 8, wherein the light fixture further includes a proximity sensor operably coupled to the controller, the controller, in at least one mode of operation, causing the light source to emit light and deactivating the nightlight upon a perceived triggering of the proximity sensor by the controller.

* * * * *